US012070123B2

(12) United States Patent
Hernandez et al.

(10) Patent No.: US 12,070,123 B2
(45) Date of Patent: Aug. 27, 2024

(54) TABLE WITH ROTATING TABLETOP

(71) Applicant: Lakeshore Learning Materials, LLC, Carson, CA (US)

(72) Inventors: Steven Hernandez, Covina, CA (US); Aryan Jafari, Los Angeles, CA (US); Alfredo Reyes, West Covina, CA (US); Joshua Kaplan, Hermosa Beach, CA (US)

(73) Assignee: Lakeshore Learning Materials, LLC, Carson, CA (US)

( * ) Notice: Subject to any disclaimer, the term of this patent is extended or adjusted under 35 U.S.C. 154(b) by 0 days.

(21) Appl. No.: 18/055,894

(22) Filed: Nov. 16, 2022

(65) Prior Publication Data

US 2024/0156248 A1 May 16, 2024

(51) Int. Cl.
*A47B 3/00* (2006.01)

(52) U.S. Cl.
CPC ..... *A47B 3/00* (2013.01); *A47B 2200/0036* (2013.01)

(58) Field of Classification Search
CPC .. A47B 3/00; A47B 3/0815; A47B 2200/0036
See application file for complete search history.

(56) References Cited

U.S. PATENT DOCUMENTS

| | | | |
|---|---|---|---|
| 4,773,337 | A | 9/1988 | Ball |
| 5,121,697 | A | 6/1992 | Baum et al. |
| 5,174,225 | A | 12/1992 | Reise et al. |
| 5,354,027 | A | 10/1994 | Cox |
| 5,957,062 | A | 9/1999 | Cox et al. |
| 6,082,271 | A | 7/2000 | Gosselin et al. |
| 6,845,723 | B2 | 1/2005 | Kottman et al. |
| D573,812 | S | 7/2008 | Saotome |
| D574,634 | S | 8/2008 | Saotome |
| D588,842 | S | 3/2009 | Saotome |
| 7,703,400 | B2 | 4/2010 | Mockel |
| 7,712,422 | B2 | 5/2010 | Bue |
| 7,765,938 | B2 | 8/2010 | Piretti |
| 7,845,290 | B2 | 12/2010 | Piretti |
| 7,908,981 | B2 | 3/2011 | Agee |

(Continued)

FOREIGN PATENT DOCUMENTS

| | | |
|---|---|---|
| CN | 201591301 U | 9/2010 |
| CN | 202190932 U | 4/2012 |

(Continued)

*Primary Examiner* — Matthew W Ing
(74) *Attorney, Agent, or Firm* — Banner & Witcoff, Ltd.

(57) ABSTRACT

A tabletop for a table that can rotate between a use position and a stowed position. The table may include at least one rotation mechanism. The rotation mechanism may comprise: a housing pivotally connected to a cross-bar, an activation rod connected to a deadbolt and a hook plate and a grip bar connected to the activation rod. When the table is in a use position, the hook plate engages an opening in the primary cross-bar, where the use position is defined as when the tabletop is oriented substantially parallel to a surface supporting the table, and when the table is in a stowed position, the deadbolt receives an engaging member that is connected to the primary cross-bar, where the stowed position is defined as when the tabletop is oriented substantially perpendicular to the surface supporting the table.

15 Claims, 8 Drawing Sheets

(56) References Cited

U.S. PATENT DOCUMENTS

| | | | | |
|---|---|---|---|---|
| 8,051,784 | B2 | 11/2011 | Hsu | |
| 8,069,795 | B1 | 12/2011 | Williams et al. | |
| 8,091,488 | B2 | 1/2012 | Chirea et al. | |
| 8,171,863 | B2 | 5/2012 | Nyenhuis et al. | |
| 8,291,830 | B2 | 10/2012 | Rutz | |
| 8,359,983 | B2 | 1/2013 | Williamson et al. | |
| 8,474,385 | B2 | 7/2013 | Saito | |
| 9,265,340 | B2 | 2/2016 | Krusin et al. | |
| 9,538,839 | B2 | 1/2017 | Favaro | |
| 9,609,945 | B2 | 4/2017 | Krusin et al. | |
| 9,848,696 | B2 | 12/2017 | Tseng | |
| D815,867 | S | 4/2018 | Herring et al. | |
| 10,213,015 | B1 | 2/2019 | Anderson et al. | |
| 2004/0065239 | A1 | 4/2004 | Chen | |
| 2009/0205541 | A1* | 8/2009 | Nyenhuis | A47B 5/00 108/124 |
| 2015/0164217 | A1 | 6/2015 | Samikkannu et al. | |
| 2016/0324309 | A1 | 11/2016 | Kassanoff et al. | |
| 2018/0000240 | A1 | 1/2018 | Yamamoto et al. | |
| 2019/0053615 | A1* | 2/2019 | Gretscher | A47B 3/0818 |
| 2019/0082823 | A1 | 3/2019 | Applegate et al. | |

FOREIGN PATENT DOCUMENTS

| | | | | |
|---|---|---|---|---|
| CN | 202950204 | U | 5/2013 | |
| CN | 103126300 | A | 6/2013 | |
| CN | 103211383 | A | 7/2013 | |
| CN | 302532040 | | 8/2013 | |
| CN | 204908425 | U | 12/2015 | |
| CN | 205618494 | U | 10/2016 | |
| CN | 304173264 | | 6/2017 | |
| CN | 304277634 | | 9/2017 | |
| CN | 107692508 | A | 2/2018 | |
| CN | 207383849 | U | 5/2018 | |
| CN | 208510273 | U | 2/2019 | |
| CN | 208639802 | U | 3/2019 | |
| CN | 208639804 | U | 3/2019 | |
| CN | 208725178 | U | 4/2019 | |
| CN | 208798784 | U | 4/2019 | |
| CN | 209677734 | U | 11/2019 | |
| CN | 209769478 | U | 12/2019 | |
| DE | 202007002775 | U1 * | 5/2007 | A47B 3/08 |
| EM | 000136908-0007 | | 6/2004 | |
| EM | 000252416-0006 | | 1/2005 | |
| EM | 001617184-0001 | | 10/2009 | |
| EM | 002544353-0001 | | 10/2014 | |
| EM | 004504587-0001 | | 11/2017 | |
| EP | 1308109 | A1 | 5/2003 | |
| EP | 1829461 | A2 | 9/2007 | |
| EP | 2446772 | A1 | 5/2012 | |
| EP | 3081112 | A1 | 10/2016 | |
| JP | D1549417 | | 5/2016 | |
| JP | 2017080226 | A | 5/2017 | |
| KR | 102348053 | B1 * | 1/2022 | |
| WO | 2016184382 | A1 | 11/2016 | |

* cited by examiner

TABLE WITH ROTATING TABLETOP

TECHNICAL FIELD

This application relates to tables with a movable tabletop.

BACKGROUND

Using space efficiently is important in many aspects. For example, to use a room in an efficient manner, sometimes the furniture needs to be arranged to accommodate multiple uses. A table that can move from a use position to allow items to be placed on the tabletop and also have a stowed position where the tabletop can move to reduce the size and footprint of the table such that the table takes up less space allows a user to use the room space more efficiently.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of this disclosure may relate to a table comprising: (a) a first base; (b) a second base spaced apart from the first base; (c) a first leg extending from the first base, where the first leg extends in a substantially perpendicular direction to the first base; (d) a second leg extending from the second base, where the second leg extends in a substantially perpendicular direction to the second base; (e) a primary cross-bar connecting the first leg and the second leg; (f) a rotation mechanism connected to the primary cross-bar, where a tabletop is fixedly connected to the rotation mechanism. The rotation mechanism may comprise: (1) a first rotation mechanism housing pivotally connected to the primary cross-bar; (2) a first activation rod, where the first activation rod is movably connected to the first rotation mechanism housing; (3) a first deadbolt connected to the first activation rod; and (4) a first hook plate connected to the first activation rod. A grip bar may be connected to the first activation rod. When the table is in a use position, the first hook plate may engage a first opening in the primary cross-bar, where the use position is defined as when a top surface of the tabletop is oriented substantially parallel to a surface supporting the table. When the table is in a stowed position, the first deadbolt may receive a first engaging member that is connected to the primary cross-bar, wherein the stowed position is defined as when the top surface of the tabletop is oriented substantially perpendicular to the surface supporting the table. The first activation rod may be connected to a first bracket, where the first bracket may be connected to the first deadbolt and to the first hook plate. The first rotation mechanism housing may include a cavity, where the first bracket is configured to slide within the cavity of the first rotation mechanism housing. In addition, the cavity may receive the first deadbolt, the first hook plate, and a portion of the first activation rod. In some examples, when the table is in the stowed position, a groove on the first deadbolt may receive the first engaging member, where the first engaging member extends substantially parallel to a side surface of the groove. The first engaging member may be connected to a first stationary box that is connected to the primary cross-bar. The rotation mechanism may be pivotally connected to the primary cross-bar via an axle located on the first stationary box. The table may further comprise a second rotation mechanism comprising: (a) a second rotation mechanism housing pivotally connected to the primary cross-bar; (b) a second activation rod connected to the grip bar, where the second activation rod is movably connected to the second rotation mechanism housing; (c) a second deadbolt connected to the second activation rod; and (d) a second hook plate connected to the second activation rod. When the table is in the use position, the second hook plate may engage a second opening in the primary cross-bar, and when the table is in the stowed position, the second deadbolt may receive a second engaging member connected to the primary cross-bar. The rotation mechanism may further comprise a biasing member aligned with the first activation rod such that when the grip bar is pulled away from the primary cross-bar, the biasing member is compressed, and the first deadbolt and the first hook plate, move away from the primary cross-bar. Lastly, the first deadbolt may be located between the first hook plate and a second hook plate, where the first hook plate and the second hook plate are connected to the first deadbolt, and where the first hook plate is received in the first opening of the primary cross-bar and the second hook plate is received in a second opening of the primary cross-bar.

Still other aspects of this disclosure may relate to a table comprising: (a) a first leg; (b) a second leg spaced apart from the first leg; (c) a primary cross-bar connecting the first leg and the second leg; and (d) a rotation mechanism connected to the primary cross-bar, where a tabletop is fixedly connected to the rotation mechanism. The rotation mechanism may comprise: (1) a rotation mechanism housing pivotally connected to the primary cross-bar; (2) an activation rod movably connected to the rotation mechanism housing; (3) a biasing member aligned with the activation rod; (4) a deadbolt connected to the activation rod; and (5) a first hook plate connected to the activation rod. A grip bar may be connected to the activation rod such that when the grip bar is pulled away from the primary cross-bar, the deadbolt and the first hook plate move away from the primary cross-bar. When the table is in a use position, the first hook plate may engage a first opening in the primary cross-bar, where the use position is defined as when a top surface of the tabletop is oriented substantially parallel to a surface supporting the table, and when the table is in a stowed position, a groove in the deadbolt may receive an engaging member that is connected to the primary cross-bar, where the stowed position is defined as when the top surface of the tabletop is oriented substantially perpendicular to the surface supporting the table. The activation rod may be connected to a bracket, where the bracket may be connected to activation rod and may also be connected to the first deadbolt. The rotation mechanism housing may include a cavity that receives the deadbolt, the first hook plate, and a portion of the activation rod. The engaging member may extend substantially perpendicular to the primary cross-bar. In some examples, the table may include a stationary box connected to the primary cross-bar, where the engaging member comprises a portion of a top wall of the stationary box and a portion of a lower wall of the stationary box. The rotation mechanism may be pivotally connected to the primary cross-bar via an axle located on the stationary box. The deadbolt may be located between the first hook plate and a second hook plate, where the second hook plate may also be connected to the deadbolt, where the first hook plate may be received in the first opening of the primary cross-bar and the second hook plate may be received in a second opening of the primary cross-bar.

Still additional aspects of this disclosure may relate to a table comprising: (a) a first base; (b) a second base spaced apart from the first base; (c) a first leg extending from the first base, where the first leg extends in a substantially perpendicular direction to the first base; (d) a second leg extending from the second base, where the second leg extends in a substantially perpendicular direction to the second base; (e) a primary cross-bar connecting the first leg and the second leg; (f) a rotation mechanism connected to the primary cross-bar; and (g) a tabletop fixedly connected to a pair of rotation mechanisms. The pair of rotation mechanisms may comprise a first rotation mechanism that includes: (1) a first rotation mechanism housing pivotally connected to the primary cross-bar; (2) a first activation rod movably connected to the first rotation mechanism housing; (3) a first biasing member aligned with the first activation rod; (4) a first deadbolt connected to the first activation rod; and (5) a first hook plate connected to the first activation rod; and a second rotation mechanism that includes: (1) a second rotation mechanism housing pivotally connected to the primary cross-bar; (2) a second activation rod movably connected to the second rotation mechanism housing; (3) a second biasing member aligned with the first activation rod; (4) a second deadbolt connected to the second activation rod; and (5) a second hook plate connected to the second deadbolt. A grip bar may be connected to the first activation rod and the second activation rod, such that when the grip bar is pulled away from the primary cross-bar, the first and second biasing members are compressed, and the first deadbolt, the second deadbolt, the first hook plate, and the second hook plate move away from the primary cross-bar. When the table is in a use position, the first hook plate may engage a first opening in the primary cross-bar, and the second hook plate may engage a second opening in the primary cross-bar, where the use position is defined as when a top surface of the tabletop is oriented substantially parallel to a surface supporting the table. When the table is in a stowed position, the first deadbolt may receive a first engaging member connected to the primary cross-bar, and the second deadbolt may receive a second engaging member connected to the primary cross-bar, where the stowed position is defined as when the top surface of the tabletop is oriented substantially perpendicular to the surface supporting the table. The table may further comprise a stationary box connected to the primary cross-bar, where the first engaging member comprises a first tab extending from a top wall of the stationary box and a second tab extending from a lower wall of the stationary box. The first deadbolt may be located between the first hook plate and a third hook plate, where the third hook plate may also be connected to the first deadbolt, and where the first hook plate is received in the first opening of the primary cross-bar and the third hook plate is received in a third opening of the primary cross-bar.

BRIEF DESCRIPTION OF DRAWINGS

The present disclosure is illustrated by way of example and not limited in the accompanying figures in which like reference numerals indicate similar elements and in which.

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. Also, while the terms "top," "bottom," "front," "side," and the like may be used in this specification to describe various example features and elements of the examples, these terms are used herein as a matter of convenience, e.g., based on the example orientations shown in the figures or the orientation during typical use. Nothing in this specification should be construed as requiring a specific three-dimensional orientation of structures in order to fall within the scope of this disclosure.

The following terms are used in this specification, and unless otherwise noted or clear from the context, these terms have the meanings provided below.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

"Substantially parallel" means that a surface or edge forms an angle of 0 degrees +/−10 degrees with another surface or edge.

"Substantially perpendicular" means that a surface or edge forms an angle of 90 degrees +/−10 degrees with another surface or edge.

Figure 1:
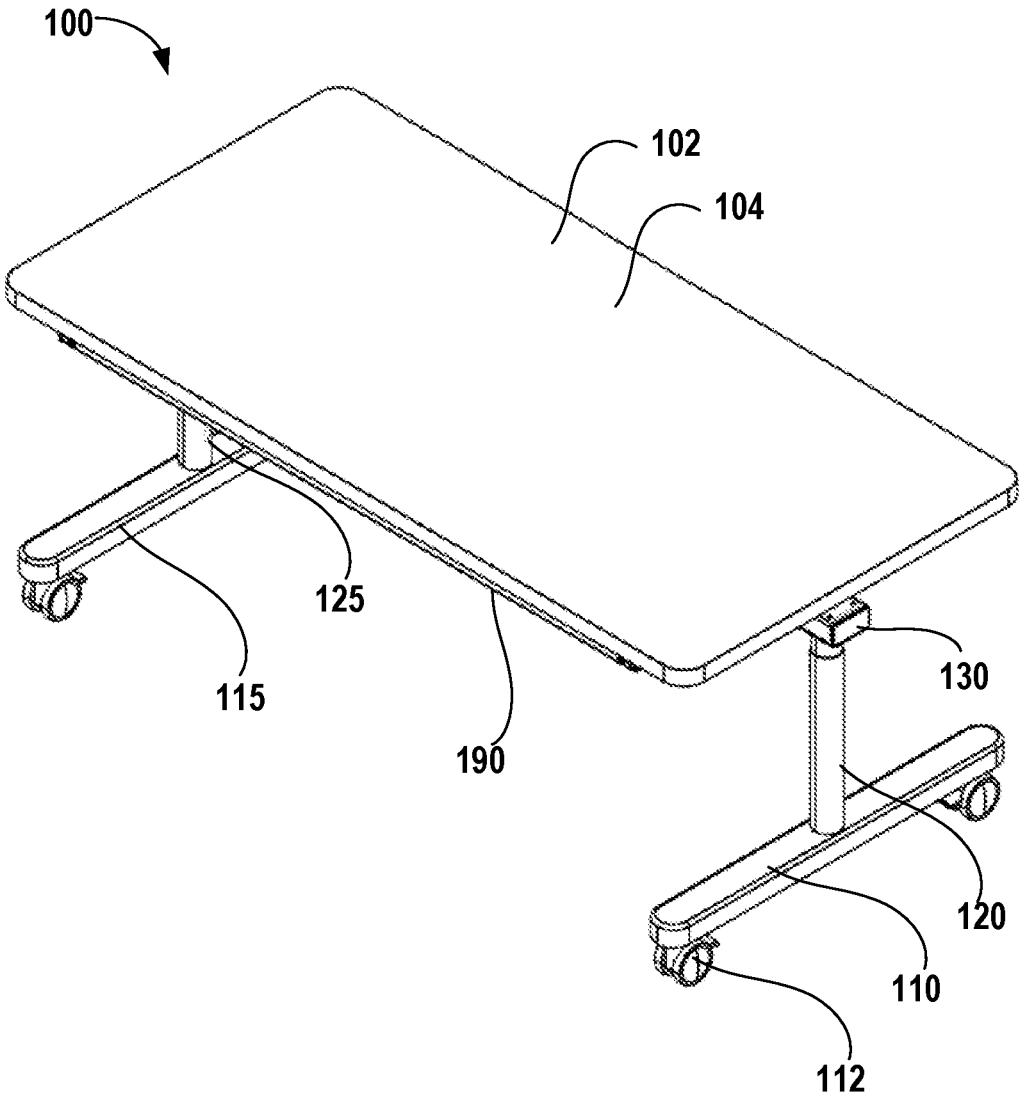
FIG. 1 depicts a perspective view of a table in a use position, according to one or more aspects described herein.
Figure 2:
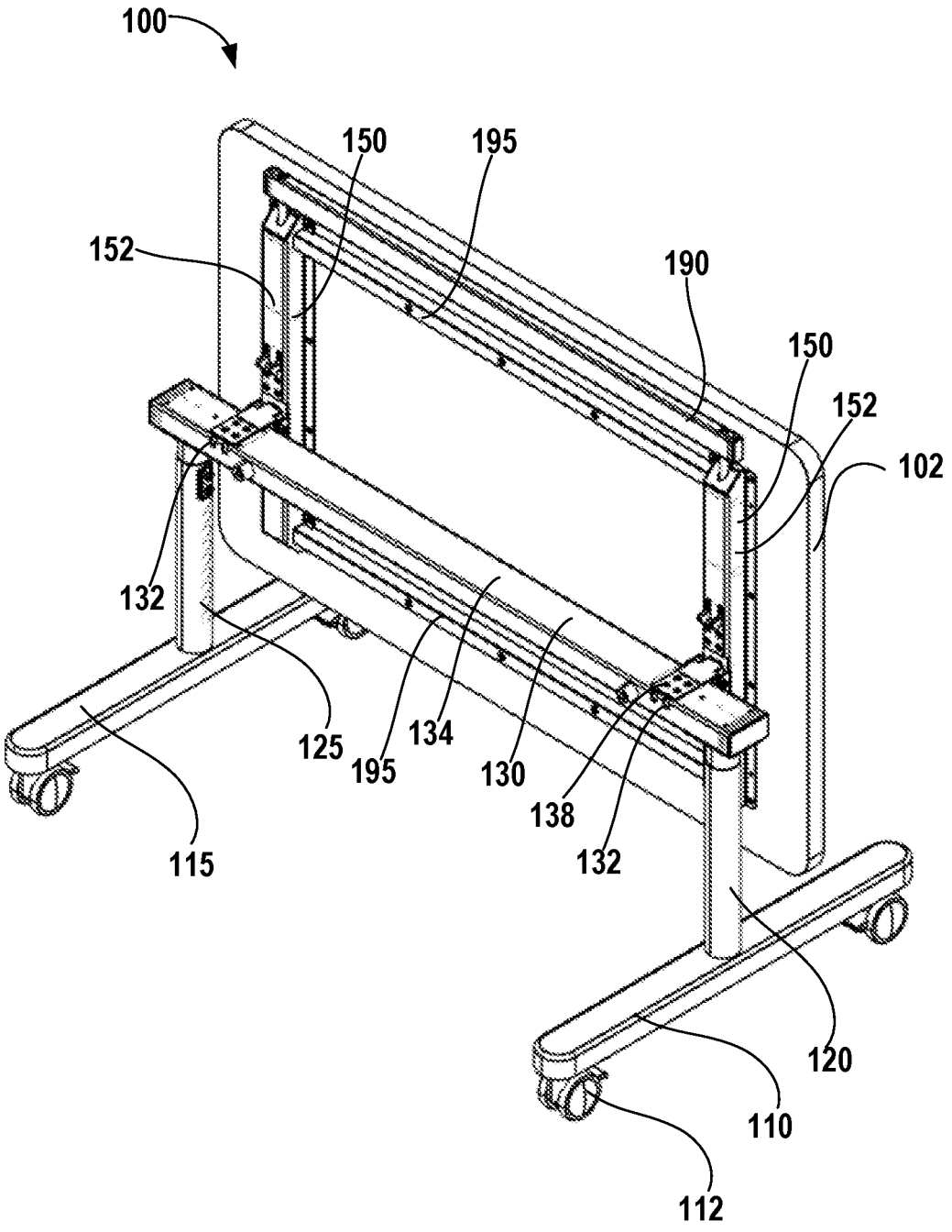
FIG. 2 depicts a perspective view of a table in a stowed position, according to one or more aspects described herein.
Figure 3:
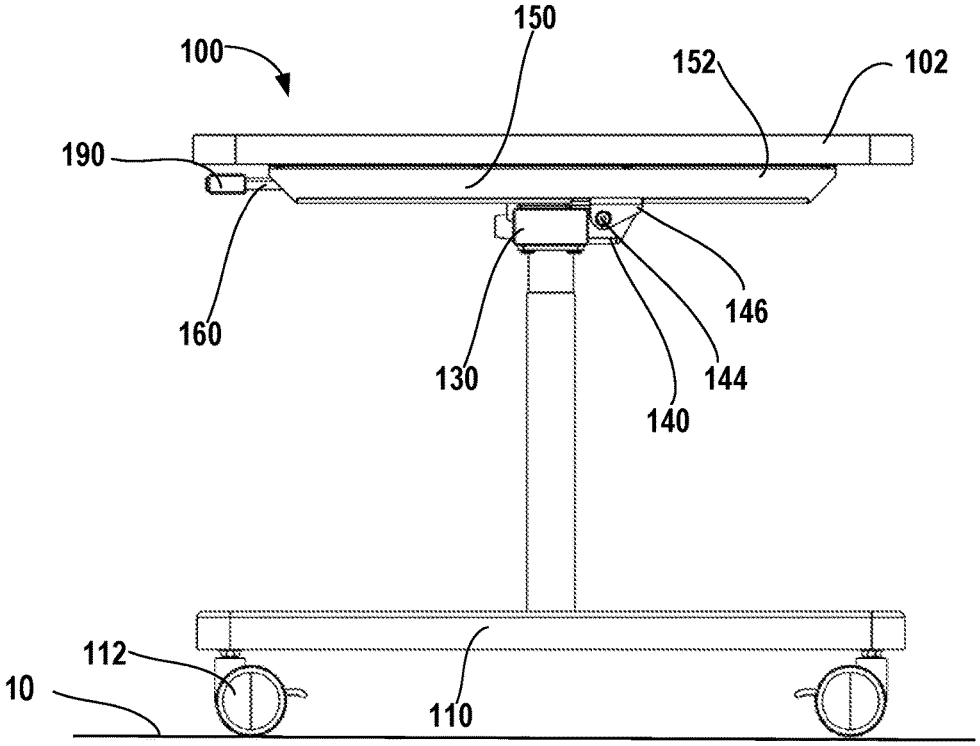
FIG. 3 depicts a side view of the table of FIG. 1 in a use position, according to one or more aspects described herein.

Aspects of this disclosure may relate to a table 100 with a tabletop 102 that can move from a use position, where a top surface 104 of the tabletop 102 is substantially parallel to the surface 10 that supports the table 100 (e.g. a floor, or deck) and arranged to support items as shown in FIG. 1, and to a stowed position as shown in FIG. 2, where the top surface 104 of the tabletop 102 is substantially perpendicular to the surface 10 that supports the table 100 to reduce the profile or footprint of the table 100 so they may be stored adjacent each other to reduce the profile of the table 100. The table 100 may comprise a first base 110, a second base 115 that is spaced apart from the first base 110, a first leg 120 extending from the first base 110, a second leg 125 extending from the second base 115, a primary cross-bar 130 that connects the first leg 120 and the second leg 125, a pair of rotation mechanisms 150 connected to the primary cross-bar 130, and the tabletop 102 fixedly connected to the pair of rotation mechanisms 150. In some examples, the table 100 may include more than two rotation mechanisms 150, such as 3, 4, or more than 4 rotation mechanisms 150. In order to secure the table 100 in the use position or in a stowed position, the rotation mechanisms 150 may include locking features that prevent the tabletop 102 from accidentally moving (i.e. prevent any unwanted movement from a stowed position to a use position, or from a use position to a stowed position) such that the table 100 will stay in the use position until acted upon by a user and will stay in the stowed position until acted upon by a user. In some examples, the use position may be defined as when the tabletop 102 is oriented substantially parallel to a surface 10 that is supporting the table 100, and the stowed position may be defined as when the tabletop 102 is oriented substantially perpendicular to the surface 10 that is supporting the table 100. In the illustrated example, the primary cross-bar 130 has a planar top surface 134 that is substantially parallel to the surface 10 supporting the table 100, so the use position may be defined as when the tabletop 102 is oriented substantially parallel the top surface 134 of the primary cross-bar 130, and the stowed position may be defined as when the tabletop 102 is oriented substantially perpendicular to the top surface 134 of the primary cross-bar 130. Alternatively, if the primary cross-bar 130 has a shape such as cylindrical or other geometric shape without a planar top surface 134, the top surface of the primary cross-bar 130 may be defined as a plane that is substantially parallel to the surface 10 supporting the table 100 and extending through an uppermost edge or point of the primary cross-bar 130.

The rotation mechanisms 150 may each comprise a rotation mechanism housing 152 that is pivotally connected to the primary cross-bar 130, an activation rod 160 that is movably connected to the rotation mechanism housing 152 and may be fixedly connected to a bracket 165, a deadbolt 170 that may be connected to the bracket 165, and a hook plate 180 that may be connected to the deadbolt 170. When the table 100 is in a use position, each hook plate 180 may engage a corresponding opening 132 located in a sidewall of the primary cross-bar 130. When the table 100 is in a stowed position, a groove or slot 174 of each deadbolt 170 may receive an engaging member 142 located on each of a pair of stationary boxes 140 that are connected to the primary cross-bar 130. In some examples, the openings 132 may be located on a portion of a sidewall and a portion of a top surface 134 of the primary cross-bar 130. Each rotation mechanism 150 may include a biasing member 162 that is aligned with a corresponding activation rod 160 (i.e. their center axes are aligned) to apply a force to help keep the hook plate 180 engaged with the opening of the primary cross-bar 130 when the table 100 is in the use position and also to help keep deadbolt 170 engaged with the engaging member 142 when the table 100 is in the stowed position. As discussed above, there may be a pair of rotation mechanisms 150 that are spaced apart from each other along the primary cross-bar 130. A grip bar 190 may extend along a majority of the length, L, of the tabletop 102 and connect to each activation rod 160 of the rotation mechanisms 150 such that a user may apply a force on the grip bar 190 to move both activation rods 160 at the same time to allow the table 100 to change positions. The primary cross-bar 130 may be centrally located along the width, W, of the tabletop 102.

FIGS. 1, 3-8 illustrate the table 100 in the use position. The rotation mechanisms 150 may rest on a top surface 134 of the primary cross-bar 130, and each rotation mechanism 150 may be pivotally attached to the primary cross-bar 130 through axle 144 located on a stationary box 140. The stationary box 140 may extend from a side of the primary cross-bar 130 and may be integrally formed with the primary cross-bar 130 or formed separately and then fixedly connected to and/or integrally joined to the primary cross-bar 130. The stationary box 140 may be located to the primary cross-bar 130 at corresponding locations to be aligned with each rotation mechanisms 150. Each rotation mechanism 150 may include a rotation mechanism housing 152 that is pivotally connected to each stationary box 140 through a hinge bracket 146 that is attached to the rotation mechanism housing 152. Each axle 144 and its corresponding stationary box 140 may be positioned on an opposite side of the primary cross-bar 130 as the grip bar 190. In this configuration, the grip bar 190 must be pulled to disengage the hook plates 180 from their corresponding openings 132 of the primary cross-bar 130 to allow the table 100 to move from the use position to the stowed position. The rotation mechanism housings 152 may extend a majority of the width, W, of the tabletop 102. In addition, the bases 110, 115 may be longer than the rotation mechanism housings 152 and may also include casters 112 to allow the table 100 to be easily moved along the floor or supporting surface 10.

Figure 4:
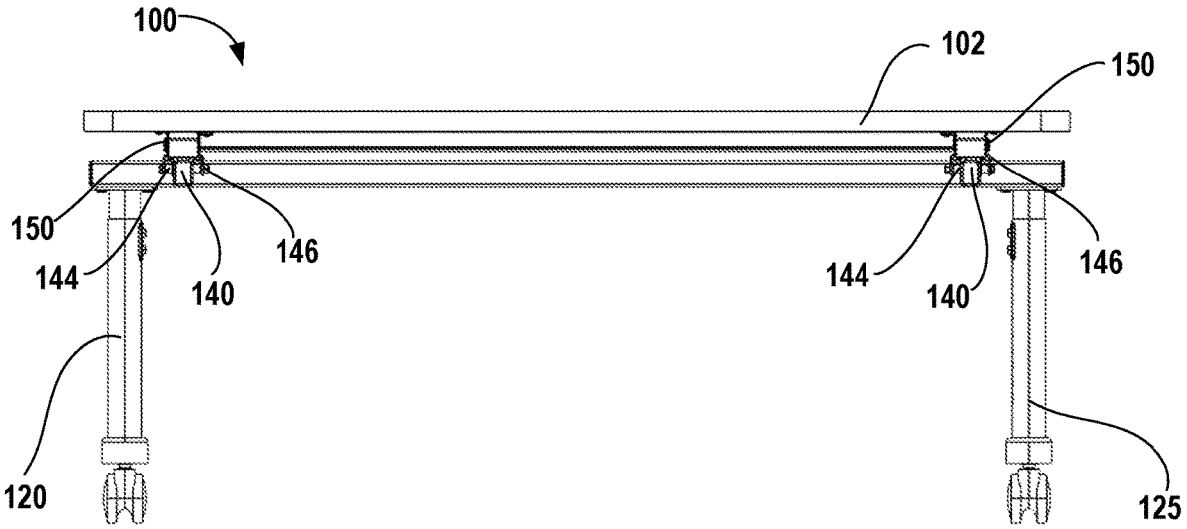
FIG. 4 depicts a front view of the table of FIG. 1 in a use position, according to one or more aspects described herein.
Figure 5:
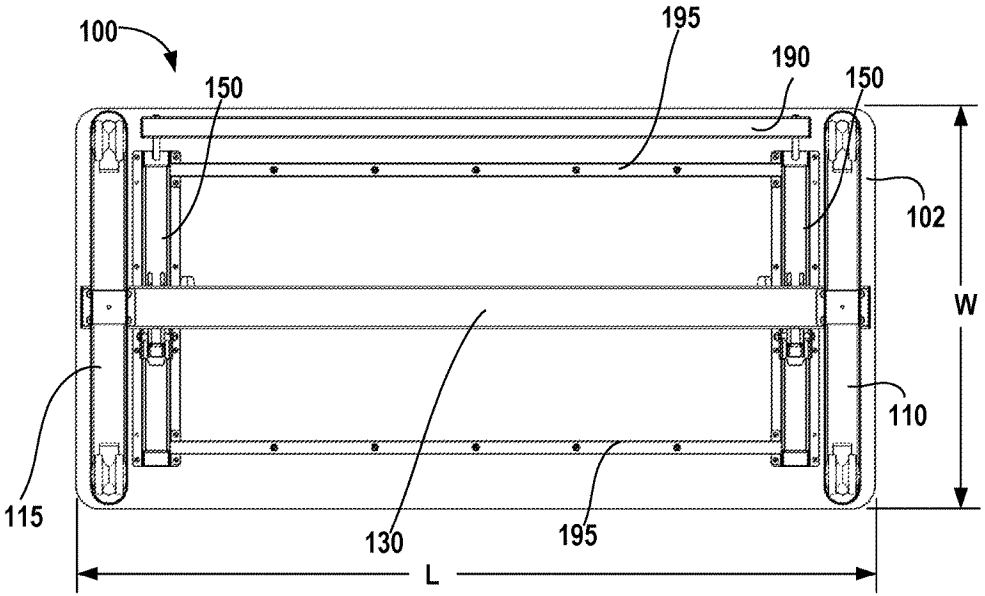
FIG. 5 depicts a bottom view of the table of FIG. 1 in a use position, according to one or more aspects described herein.
Figure 6:
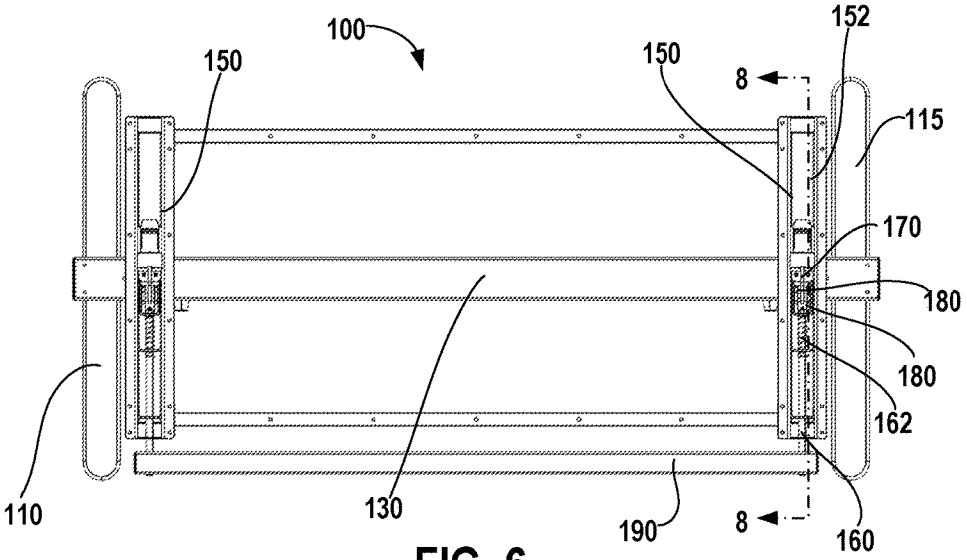
FIG. 6 depicts a top view of the table of FIG. 1 in a use position with the tabletop removed, according to one or more aspects described herein.

As shown in FIGS. 4-6, the rotation mechanisms 150 may be spaced apart from each other, but located inboard of the first base 110 and the second base 115 such that the distance between the first and second bases 110, 115 is greater than the distance between the pair of rotation mechanisms 150. The table 100 may include one or more secondary cross-bars 195 that connect to each of the rotation mechanism housings 152. The secondary cross-bars may be spaced from and located on opposite sides of the primary cross-bar 130. In addition, the secondary cross-bars 195 may be substantially parallel to the primary cross-bar 130. The secondary cross-bars 195 may fixedly connect near the ends of the rotation mechanism housings 152 and provide additional lateral stability to the table 100. In addition, these secondary cross-bars 195 may also be fixedly connected to the tabletop 102.

Figure 7:
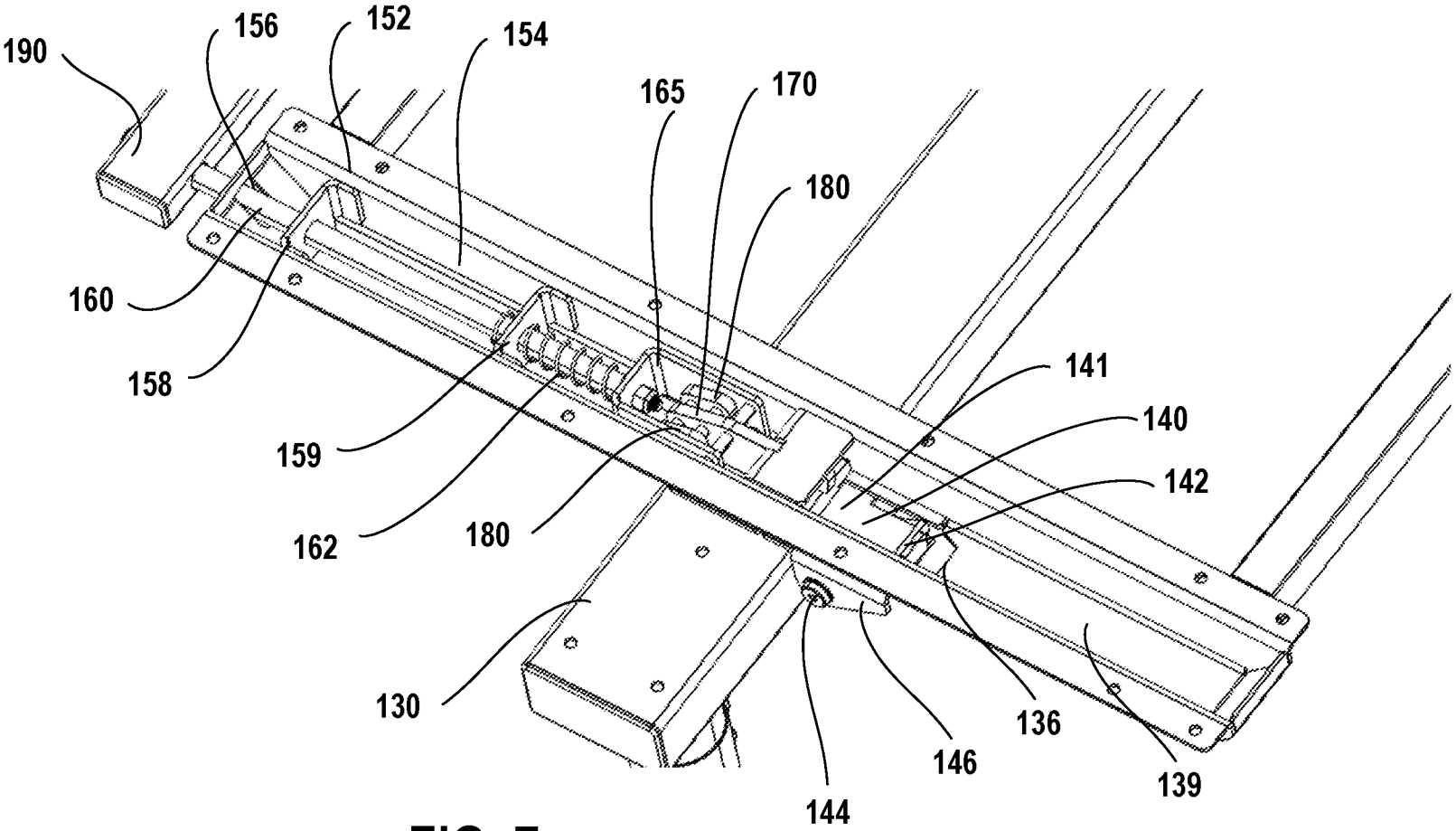
FIG. 7 depicts a partial perspective view of the table of FIG. 1 in a use position with the tabletop removed, according to one or more aspects described herein.
Figure 8:
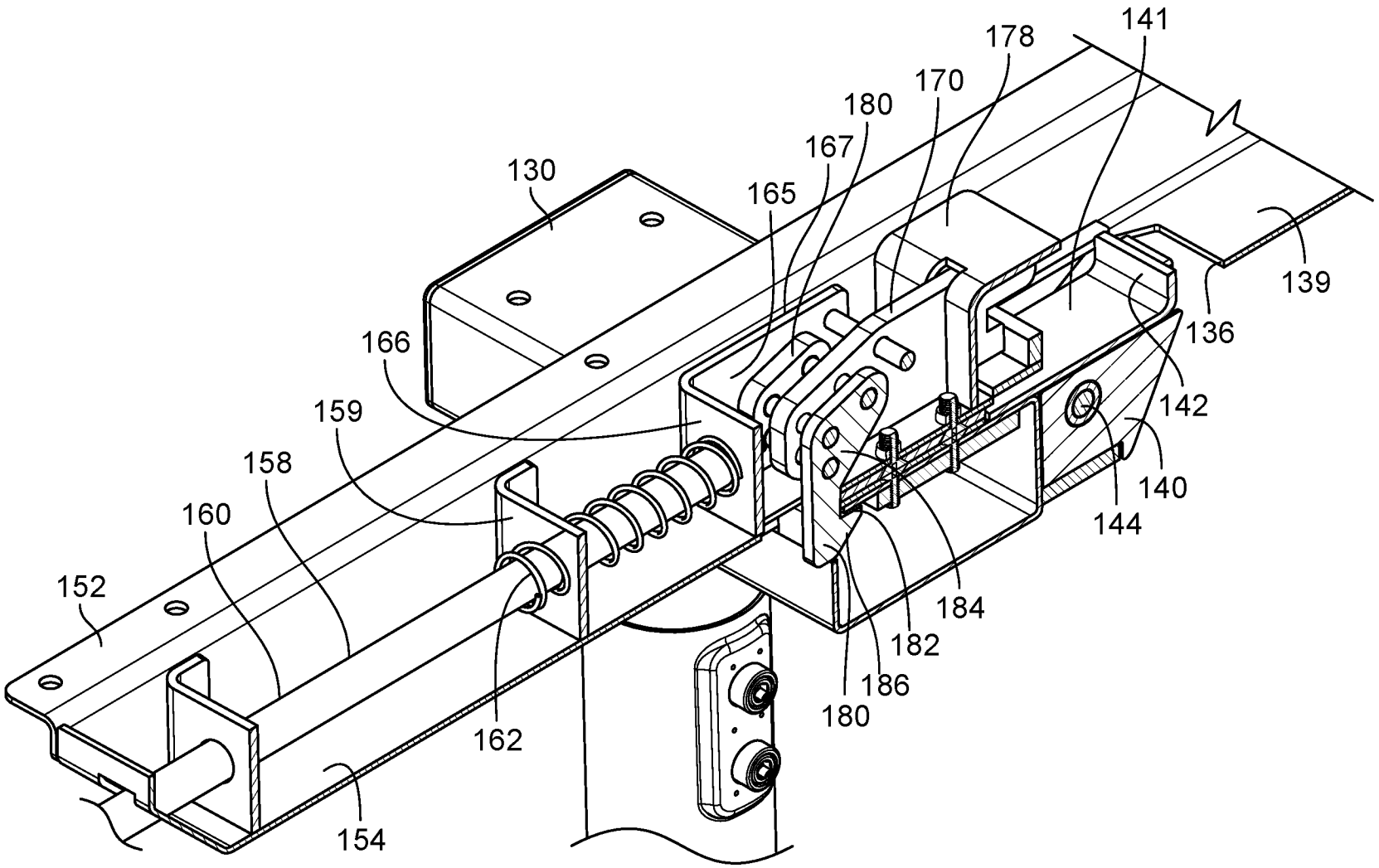
FIG. 8 depicts a perspective cross-sectional view of the table of FIG. 1 in a use position with the tabletop removed along line 8-8, according to one or more aspects described herein.
Figure 10:
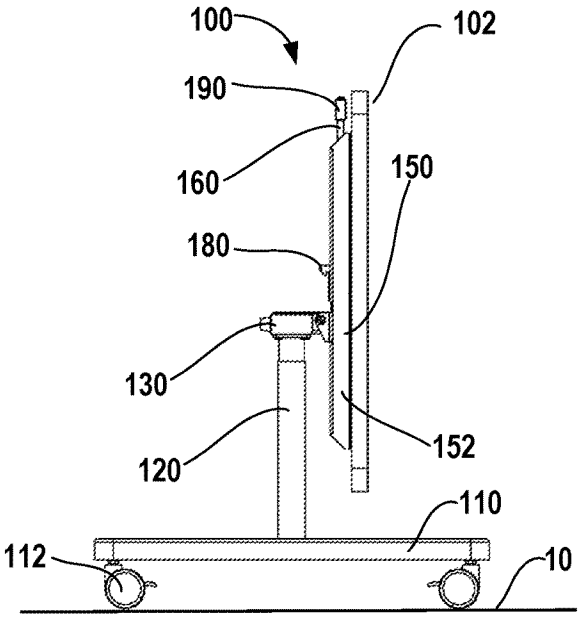
FIG. 10 depicts a side view of the table of FIG. 1 in a stowed position, according to one or more aspects described herein.

FIGS. 7-8 provide more detail to the locking features of the rotation mechanism 150 when the table 100 is in the use position. The rotation mechanism housing 152 may include a cavity 154 that receives the activation rod 160, the bracket 165, the deadbolt 170, the hook plate 180, and the biasing member 162. The cavity 154 provides a space for the various components to move without interference from the tabletop 102. In some examples, the tabletop 102 encloses the cavity 154 along with the moving components to keep a user from getting anything caught in the components for improved safety. As shown in FIGS. 7-8, the activation rod 160 is connected to the grip bar 190 and extends through an opening 156 in an end of the rotation mechanism housing 152. The activation rod 160 may also extend through openings in guide walls 158, 159 that help to support the activation rod 160. The activation rod 160 may connect to the bracket 165, where the bracket is slidably engaged with the rotation mechanism housing 152. In the illustrated example, the biasing member 162 may extend between and the guide wall 159 and the bracket 165 to apply a compressive force on to the bracket 165. The location of the guide wall 159 and the spring constant of the biasing member 162 may be used to set a predetermined force for the biasing member 162 to exert. The deadbolt 170 may be fixedly connected to the bracket 165, and a pair of hook plates 180 may be fixedly connected to the deadbolt 170, with the deadbolt 170 located in between the pair of hook plates 180. In this arrangement of a pair of hook plates 180 on both sides of the deadbolt 170, a first hook plate 180 of the pair of hook plates 180 may be received in a first opening 132 and the second hook plate 180 of the pair of hook plates 180 may be received in a second opening 132 that is spaced apart from but located closely to the first opening 132. With this arrangement any movement of the grip bar 190 in a direction away from the rotation mechanism housing 152 causes the bracket 165, the deadbolt 170, and the pair of hook plates 180 to all move simultaneously while also compressing the biasing member 162. As shown FIG. 8, the hook feature or undercut 182 of each hook plate 180 is received in a corresponding opening 132 positioned in the primary cross-bar 130, while the body member 184 of the hook plate 180 is connected to the body member 172 of the deadbolt 170. Each hook feature 182 of each hook plate 180 engages a corresponding opening 132 in the primary cross-bar 130 in a similar manner to provide a robust system that can still secure the tabletop 102 in the use position even if one of the hook plates 180 fails to successfully engage it corresponding opening 132. The deadbolt 170 and the hook plates 180 may be fixed to each other using releasable mechanical fasteners, such as screws or bolts, or permanent mechanical fasteners such as press fit pins or other means known to one skilled in the art. Similarly, the deadbolt 170 may be connected to the bracket 165 using releasable mechanical fasteners, such as screws or bolts, or permanent mechanical fasteners such as press fit pins or other means known to one skilled in the art. As another option, the hook plate 180 may be connected directly to the bracket 165 or may be connected directly to the activation rod 160. Similarly, the deadbolt 170 may be connected to the bracket 165 via a connection to the hook plate 180, or may be connected directly to the activation rod 160. The bracket 165 may be U-shaped with the rear wall 166 connected to the activation rod 160 and side walls 167 connected to one or both of the hook plates 180 or the deadbolt 170. Alternatively, or optionally, each rotation mechanism 150 may have only a single hook plate 180.

Additionally, a stationary box 140 may be connected to the primary cross-bar 130 and may include an engaging member 142 that extends upward from the stationary box 140 through a lower opening 136 in a bottom wall 139 of the rotation mechanism housing 152. The axle 144 may extend through an opening in the hinge bracket 146 and the stationary box 140. In some examples, the deadbolt 170 may extend through an elongated opening in a guide bracket 178 to help support the deadbolt 170.

Figure 9:
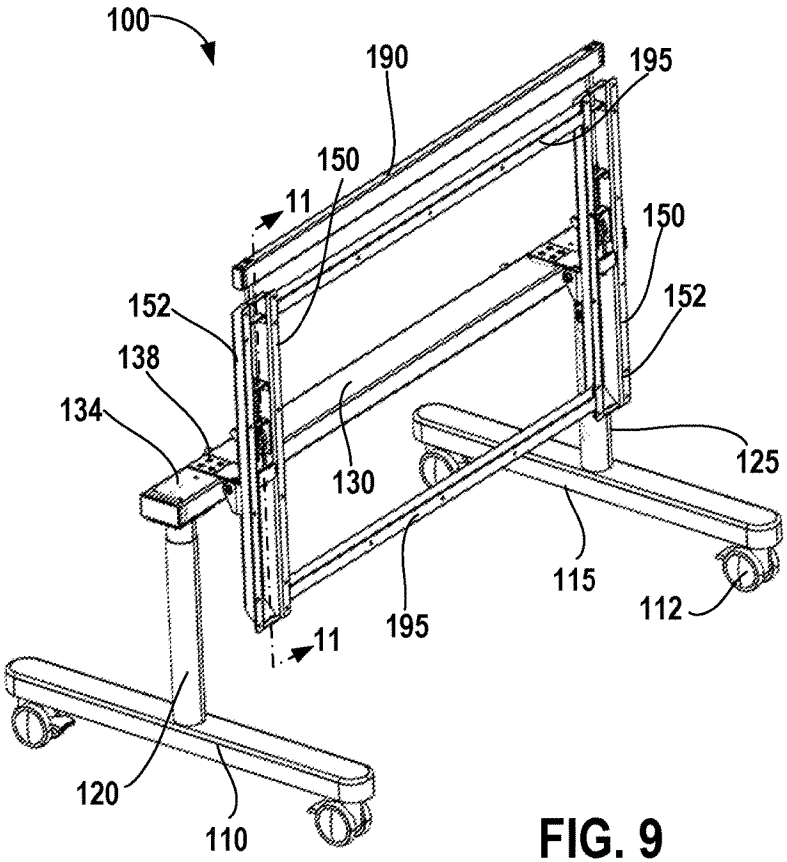
FIG. 9 depicts a perspective view of the table of FIG. 1 in a stowed position with the tabletop removed, according to one or more aspects described herein.
Figure 12:
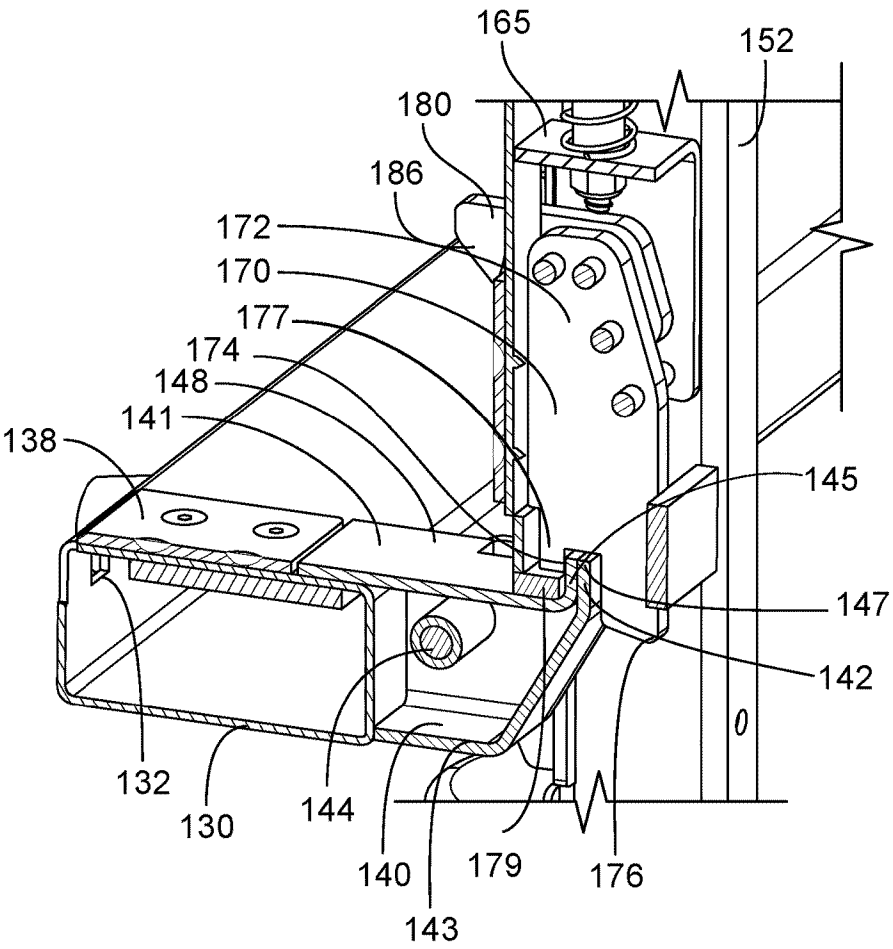
FIG. 12 depicts an enlarged view of the cross-sectional view of FIG. 11.
Figure 11:
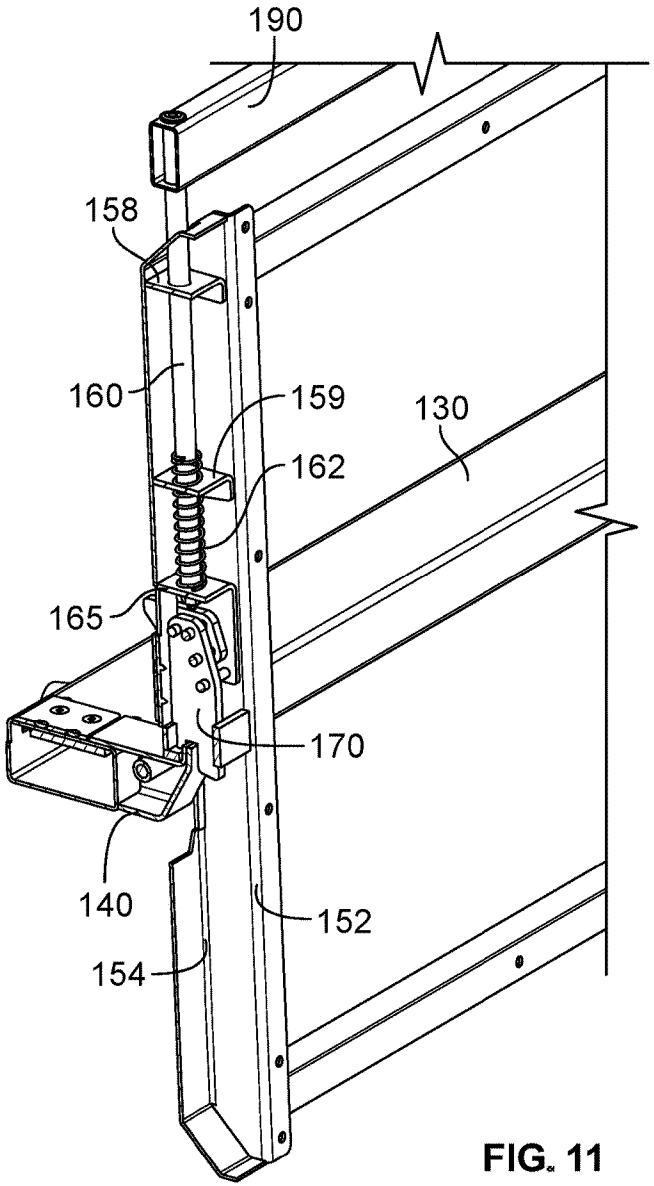
FIG. 11 depicts a perspective cross-sectional view of the table of FIG. 1 in a use position with the tabletop removed along line 11-11, according to one or more aspects described herein.

Referring now to FIGS. 2 and 9-12 that illustrate the table 100 in a stowed position. When the table 100 is in the stowed position, the tabletop 102 may be located substantially perpendicular to the surface 10 supporting the table 100. As shown in FIG. 9, the rotation mechanisms 150 are arranged substantially perpendicular to the top surface 134 of the primary cross-bar 130 and substantially perpendicular to the surface 10 supporting the table 100. To secure the table 100 in the stowed position, the groove or slot 174 of the deadbolt 170 receives the engaging member 142. The engaging member 142 may extend from the top wall 141 in a direction substantially parallel to a side surface of the groove 174. The deadbolt 170 may have a first elongated tab 176 adjacent the groove 174 that extends along the engaging member 142 just beyond the perimeter of the stationary box 140 to assist in securing the deadbolt 170 to the engaging member 142. The deadbolt 170 may also include a second elongated tab 177 on the opposite side of the groove 174 from the first elongated tab 176. Thus, the groove 174 is located between the first and second elongated tabs 176, 177. A stop 179 may be connected to a distal end of the second elongated tab 177. The stop 179 may be oriented substantially perpendicular to the distal end of the second elongated tab 177. The stop 179 may be formed as a plate and fixedly connected or integrally joined to the distal end of the second elongated tab 177. The stop 179 may engage the top wall 141 to create a hard stop for deadbolt 170 to reach a fully locked position to put the tabletop 102 into the stowed position. The stop 179 may have a length that is greater than a thickness of the deadbolt 170 and may extend to be equal or greater than a width of the top wall 141. The engaging member 142 may extend above a top surface 148 of the stationary box 140 by a distance of 12.5 mm or within a range of 10 mm and 20 mm. In some examples, the engaging member 142 may comprise a first tab 145 extending from a top wall 141 of the stationary box 140 and a second tab 147 extending from a lower wall 143 of the stationary box 140. The first tab 145 may be formed from a portion of a top wall 141 of the stationary box 140 that is bent upwards, and the second tab 147 may be formed from a portion of a lower wall 143 of the stationary box 140 that is bent upwards. The two tabs 145, 147 may be located adjacent to each other and may contact each other, where both tabs 145, 147 form the engaging member 142 as shown in FIG. 12. The thickness of the engaging member 142 may be defined as the combined thickness of the wall thickness of the lower wall 143 and the top wall 141. In some examples, the wall thickness of the lower wall 143 and of the top wall 141 may be equal. Thus, the thickness of the engaging member 142 may be defined as twice the thickness of the lower wall 143 or twice the thickness of the top wall 141. The groove 174 of the deadbolt 170 may have a width that is greater than twice the thickness of the top wall 141 of the stationary box.

To move the table 100 from a use position to a stowed position, a user may pull the grip bar 190 away from the primary cross-bar 130. As the grip bar 190 moves away from the primary cross-bar 130, the activation rod 160 moves outward and also moves the bracket 165 along with the hook plates 180 away from the primary cross-bar 130, which moves the hook feature 182 of each hook plate 180 away from and clear of their corresponding opening 132 in a sidewall of the primary cross-bar 130. Once the hook features 182 are clear of their corresponding openings 132, the user may rotate the tabletop 102 towards a stowed position. As the tabletop 102 approaches being substantially perpendicular to surface 10 supporting the table 100, the groove 174 of the deadbolt 170 begins to engage and receive the engaging member 142. Once the engaging member 142 is fully received in the groove 174 of the deadbolt 170, the table 100 is in the stowed position, where the biasing member 162 applies a compressive force to the deadbolt 170 to keep the deadbolt 170 engaged with the engaging member 142 to prevent the tabletop 102 from moving relative to the primary cross-bar 130.

Similarly, to move the table 100 from a stowed position to a use position, a user may pull the grip bar 190 away from the primary cross-bar 130. As the grip bar 190 moves away from the primary cross-bar 130, the activation rod 160 moves outward and also moves the bracket 165 along with the deadbolt 170 away from the primary cross-bar 130, which moves the groove 174 upward away from and clear of its corresponding engaging member 142. Once the groove 174 clears their engaging member 142, the user may rotate the tabletop 102 towards a use position. As the tabletop 102 approaches being substantially parallel to the surface 10 supporting the table 100, the hook plates 180 may contact a contact plate 138 on a top surface 134 of the primary cross-bar. Each hook plate 180 may include an angled surface 186 adjacent the hook feature 182 that may help to guide the hook feature 182 into its corresponding opening 132 of the primary cross-bar 130. As the angled surface 186 contacts the contact plate 138, an edge of the contact plate 138 may slide along the angled surface 186 until the angled surface 186 is below the contact plate 138. Once the angled surface 186 is below the contact plate 138, the force from the biasing member 162 may push the hook features 182 into their corresponding openings of the primary cross-bar 130 securing the table 100 in the use position. The compressive force from the biasing member 162 will prevent the table 100 from moving out of the use position until acted upon by a user.

The components such as the primary cross-bar 130, the contact plate 138, the stationary boxes 140, the rotation mechanism housings 152, the guide walls 158, 159, the brackets 165, 178, the deadbolts 170, the stop 179, the hook plates 180, the grip bar 190, and the secondary cross-bars 195 may be formed from a metallic material, such as a steel alloy, aluminum alloy, or other suitable metallic material. The contact plate 138 may be formed from a material that is a greater hardness than the material of the primary cross-bar 130. The biasing member 162 may be a compression spring that is arranged to supply a predetermined amount of force to prevent the table 100 from moving from a use position or from a stowed position unless acted upon by a sufficient force on the grip bar by a user to overcome the predetermined force provided by the biasing member 162.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

We claim:

1. A table comprising:

a first base;

a second base spaced apart from the first base;

a first leg extending from the first base, wherein the first leg extends in a substantially perpendicular direction to the first base;

a second leg extending from the second base, wherein the second leg extends in a substantially perpendicular direction to the second base;

a primary cross-bar connecting the first leg and the second leg;

a rotation mechanism connected to the primary cross-bar, wherein a tabletop is fixedly connected to the rotation mechanism;

wherein the rotation mechanism comprises:

a first rotation mechanism housing pivotally connected to the primary cross-bar, a first activation rod, wherein the first activation rod is movably connected to the first rotation mechanism housing;

a first deadbolt connected to the first activation rod; and a first hook plate connected to the first activation rod; and a grip bar is connected to the first activation rod;

wherein when the table is in a use position, the first hook plate engages a first opening in the primary cross-bar, wherein the use position is defined as when a top surface of the tabletop is oriented substantially parallel to a surface supporting the table; and wherein when the table is in a stowed position, the first deadbolt receives a first engaging member that is connected to a first stationary box on the primary cross-bar and a groove on the first deadbolt receives the first engaging member, wherein the first engaging member extends substantially parallel to a side surface of the groove, wherein the stowed position is defined as when the top surface of the tabletop is oriented substantially perpendicular to the surface supporting the table.

2. The table of claim 1, wherein the first activation rod is connected to a first bracket, and wherein the first bracket is connected to the first deadbolt and to the first hook plate.

3. The table of claim 2, wherein the first rotation mechanism housing includes a cavity, wherein the first bracket is configured to slide within the cavity of the first rotation mechanism housing.

4. The table of claim 1, wherein the first rotation mechanism housing includes a cavity that receives the first deadbolt, the first hook plate, and a portion of the first activation rod.

5. The table of claim 1, wherein the rotation mechanism is pivotally connected to the primary cross-bar via an axle located on the first stationary box.

6. The table of claim 1, further comprising a second rotation mechanism comprising:

a second rotation mechanism housing pivotally connected to the primary cross-bar;

a second activation rod connected to the grip bar, wherein the second activation rod is movably connected to the second rotation mechanism housing;

a second deadbolt connected to the second activation rod; and a second hook plate connected to the second activation rod;

wherein when the table is in the use position, the second hook plate engages a second opening in the primary cross-bar; and wherein when the table is in the stowed position, the second deadbolt receives a second engaging member connected to the primary cross-bar.

7. The table of claim 1, wherein the rotation mechanism further comprises a biasing member aligned with the first activation rod such that when the grip bar is pulled away from the primary cross-bar, the biasing member is compressed, and the first deadbolt and the first hook plate, move away from the primary cross-bar.

8. The table of claim 1, wherein the first deadbolt is located between the first hook plate and a second hook plate, wherein the first hook plate and the second hook plate are connected to the first deadbolt, wherein the first hook plate is received in the first opening of the primary cross-bar and the second hook plate is received in a second opening of the primary cross-bar.

9. A table comprising:
a first leg;
a second leg spaced apart from the first leg;
a primary cross-bar connecting the first leg and the second leg;
a rotation mechanism connected to the primary cross-bar, wherein a tabletop is fixedly connected to the rotation mechanism;
wherein the rotation mechanism comprises:
a rotation mechanism housing pivotally connected to the primary cross-bar;
an activation rod movably connected to the rotation mechanism housing;
a biasing member aligned with the activation rod;
a deadbolt connected to the activation rod; and
a first hook plate connected to the activation rod; and
a grip bar connected to the activation rod such that when the grip bar is pulled away from the primary cross-bar, the deadbolt and the first hook plate move away from the primary cross-bar;
wherein when the table is in a use position, the first hook plate engages a first opening in the primary cross-bar, wherein the use position is defined as when a top surface of the tabletop is oriented substantially parallel to a surface supporting the table; and
wherein when the table is in a stowed position, a groove in the deadbolt receives an engaging member that is connected to the primary cross-bar, wherein the engaging member extends substantially perpendicular to the primary cross-bar, and wherein the stowed position is defined as when the top surface of the tabletop is oriented substantially perpendicular to the surface supporting the table; and
wherein the table includes a stationary box connected to the primary cross-bar, wherein the engaging member comprises a portion of a top wall of the stationary box and a portion of a lower wall of the stationary box.

10. The table of claim 9, wherein the activation rod is connected to a bracket, and wherein the bracket is connected to activation rod and also connected to the deadbolt.

11. The table of claim 10, wherein the rotation mechanism housing includes a cavity that receives the deadbolt, the first hook plate, and a portion of the activation rod.

12. The table of claim 9, wherein the rotation mechanism is pivotally connected to the primary cross-bar via an axle located on the stationary box.

13. The table of claim 9, wherein the deadbolt is located between the first hook plate and a second hook plate, wherein the second hook plate is also connected to the deadbolt, wherein the first hook plate is received in the first opening of the primary cross-bar and the second hook plate is received in a second opening of the primary cross-bar.

14. A table comprising:
a first base;
a second base spaced apart from the first base;
a first leg extending from the first base, wherein the first leg extends in a substantially perpendicular direction to the first base;
a second leg extending from the second base, wherein the second leg extends in a substantially perpendicular direction to the second base;
a primary cross-bar connecting the first leg and the second leg;
a first rotation mechanism connected to the primary cross-bar, wherein a tabletop is fixedly connected to a pair of rotation mechanisms;
wherein the first rotation mechanism of the pair of rotation mechanisms comprises:
a first rotation mechanism housing pivotally connected to the primary cross-bar;
a first activation rod movably connected to the first rotation mechanism housing;
a first biasing member aligned with the first activation rod;
a first deadbolt connected to the first activation rod; and
a first hook plate connected to the first activation rod; and
wherein a second rotation mechanism of the pair of rotation mechanisms comprises:
a second rotation mechanism housing pivotally connected to the primary cross-bar,
a second activation rod movably connected to the second rotation mechanism housing;
a second biasing member aligned with the first activation rod;
a second deadbolt connected to the second activation rod; and
a second hook plate connected to the second deadbolt;
a grip bar connected to the first activation rod and the second activation rod, such that when the grip bar is pulled away from the primary cross-bar, the first and second biasing members are compressed, and the first deadbolt, the second deadbolt, the first hook plate, and the second hook plate move away from the primary cross-bar;
a stationary box connected to the primary cross-bar; and
wherein when the table is in a use position, the first hook plate engages a first opening in the primary cross-bar and the second hook plate engages a second opening in the primary cross-bar, wherein the use position is defined as when a top surface of the tabletop is oriented substantially parallel to a surface supporting the table; and
wherein when the table is in a stowed position, the first deadbolt receives a first engaging member connected to the primary cross-bar, and the second deadbolt receives a second engaging member connected to the primary cross-bar, wherein the stowed position is defined as when the top surface of the tabletop is oriented perpendicular to the surface supporting the table; and
wherein the first engaging member comprises a first tab extending from a top wall of the stationary box and a second tab extending from a lower wall of the stationary box.

15. The table of claim 14, wherein the first deadbolt is located between the first hook plate and a third hook plate, wherein the third hook plate is also connected to the first deadbolt, and wherein the first hook plate is received in the first opening of the primary cross-bar and the third hook plate is received in a third opening of the primary cross-bar.

* * * * *